United States Patent [19]

Lilly et al.

[11] 4,229,813

[45] Oct. 21, 1980

[54] ELAPSED TIME INDICATOR

[75] Inventors: Robert L. Lilly; Gerardus L. J. Tummers, both of Asheville; Claude D. Johnson, Arden; Roger D. Davis, Fletcher, all of N.C.

[73] Assignee: Akzona Incorporated, Asheville, N.C.

[21] Appl. No.: 919,005

[22] Filed: Jun. 26, 1978

[51] Int. Cl.[3] ..... G04F 13/06

[52] U.S. Cl. ..... 368/89; 116/206; 422/56; 116/308

[58] Field of Search ..... 116/206, 207, 219, 200; 73/356; 58/1 R; 368/89

[56] References Cited

U.S. PATENT DOCUMENTS

| | | | |
|---|---|---|---|
| 2,490,933 | 12/1949 | Tornquist et al. | 116/219 |
| 2,716,065 | 8/1955 | Beckett et al. | 116/207 |
| 3,055,759 | 9/1962 | Busby et al. | 116/207 |
| 3,414,415 | 12/1968 | Broad, Jr. | 116/219 |
| 3,520,124 | 7/1970 | Myers | 58/1 R |
| 3,620,677 | 11/1971 | Morison | 116/200 |
| 3,954,011 | 5/1976 | Manske | 58/1 R |
| 3,958,528 | 5/1976 | Hill | 116/219 |
| 4,028,876 | 6/1977 | Delatorre | 116/206 X |
| 4,038,873 | 8/1977 | Kimmel | 116/206 X |
| 4,148,272 | 4/1979 | Wetzolf | 58/1 R |

*Primary Examiner*—Daniel M. Yasich

*Attorney, Agent, or Firm*—Francis W. Young; David M. Carter

[57] ABSTRACT

A time indicator which is substantially unaffected by variations in temperature. The indicator utilizes a silicone oil which is slowly absorbed onto and moves up a porous strip at a rate which is a function of time. One side of the strip is printed with an oil soluble ink, while the other side is unprinted. The printed side of the strip is laminated with polyethylene film to an unprinted strip. As the silicone oil moves up the strip, the oil contacts the ink causing a dye in the ink to migrate from the printed side to the unprinted side, thus providing a measurable color front moving up the strip. The oil is contained in a frangible ampul and a sponge with a small hole at the bottom is situated between the ampul and the strip. The indicator is substantially unaffected by normal variations in temperature and humidity.

17 Claims, 3 Drawing Figures

ELAPSED TIME INDICATOR

BACKGROUND OF THE INVENTION

This invention relates to an improved elapsed time indicator. More particularly, it relates to an elapsed time indicator which is substantially unaffected by normal temperature and humidity variations.

It has been found that there is a need for an inexpensive but accurate time indicator which provided a clear and measurable indication of the passage of a predetermined time. The ideal device should be substantially independent of physical changes in its surroundings, such as changes in temperature and humidity. A particular need for such a device has arisen for use with intravenous tubing particularly in hospital applications.

In order to prevent infection, intravenous tubing in use by a patient should be replaced every 24 hours. The procedure now, in most cases, is for the nurse to check her watch and record the time that the fluid first begins to flow through the intravenous tubing which is attached to the patient. She then tries to remember when the 24 hour period has elapsed so that she may change the tubing. Another mechanism which has been tried is the use of four differently colored dots which are attached to the tubing and which are individually torn off as the nurse makes her rounds every six hours, thus when the last dot is torn off, the nurse would know that 24 hours has elapsed. It has been found that, due to human error, these particular types of methods of providing an indication of when the tubing is to be replaced have not worked.

There are various active chemical indicators, which provide visible information as to the elapse of time. One such indicator is set forth in U.S. Pat. No. 3,620,677, assigned to the Miles Laboratory, Inc. However, the Miles patent is more useful as a time-temperature indicator, that is, a device which integrates both time and temperature since Miles utilizes a chemical reaction in the indication process which is affected by changes in temperature. Other devices have been suggested which would act as a time indicator. One such device is set forth in U.S. Pat. No. 4,137,049, issued Jan. 30, 1979, entitled *A Device For Use as an Elapsed Time Indicator or Time Temperature Indicator,* and assigned to Akzona Incorporated, assignee of the present invention. While this device functioned quite well as a time indicator for a certain range of temperatures, it was found that it was affected by changes in relative humidity. Thus, it is desirable to provide an improved time indicator which overcomes the deficiencies of the prior art.

OBJECTS OF THE INVENTION

It is one subject of this invention to provide an improved time indicator.

It is another object to provide a low cost, easy to read time indicator.

It is a further object of this invention to provide a time indicator which is substantially unaffected by changes in temperature and relative humidity.

It is still a further object to provide a time indicator particularly adapted for use with intravenous tubing.

SUMMARY OF THE INVENTION

In accordance with one form of this invention, there is provided a time indicator which includes a reservoir of silicone oil contained in a frangible housing. A porous strip is further provided, having an ink printed on one side. A porous barrier may have a small hole drilled therethrough. The ampul, strip and porous barrier are all enclosed in a housing which has an optically clear portion to show a color front on the strip. Another feature of this invention is that the strip may be multilayered, having one strip of porous material sandwiched to another strip. The ink is between the two strips so that it is protected and will not run up the back side of the housing.

BRIEF DESCRIPTION OF THE DRAWINGS

The subject matter which is regarded as the invention is set forth in the appended claims. The invention itself, however, together with further objects and advantages thereof, may be better understood by reference to the following description in which:

DESCRIPTION OF THE PREFERRED EMBODIMENT

Figure 1:
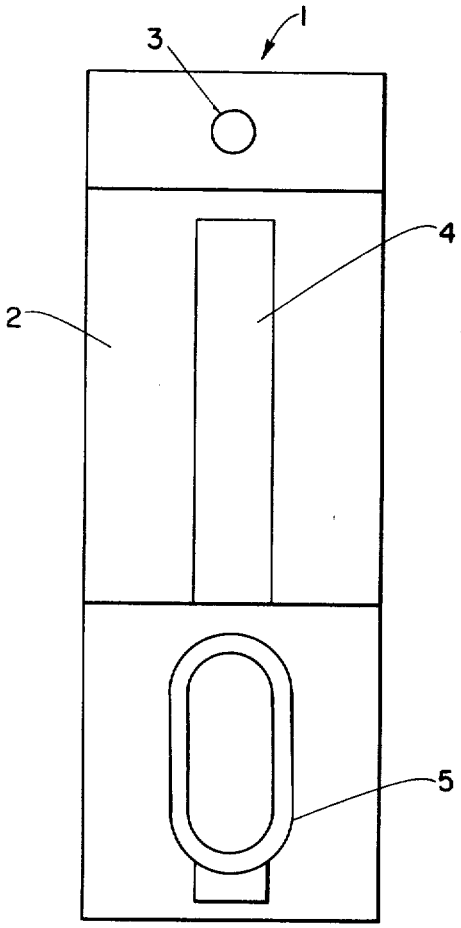
FIG. 1 is a plan view of the indicator of the present invention.

Referring now more particularly to FIG. 1, there is provided time indicator 1 which includes front portion 2 in the form of a plastic blister. Time indicator 1 includes a hole 3 at the top of the indicator particularly adapted to have intravenous tubing inserted therethrough. Thus the time indicator is held in an upright position near an intravenous solution bottle so that a nurse may be able to easily read the time indicator and thus know when to dispose of the tubing.

Figure 2:
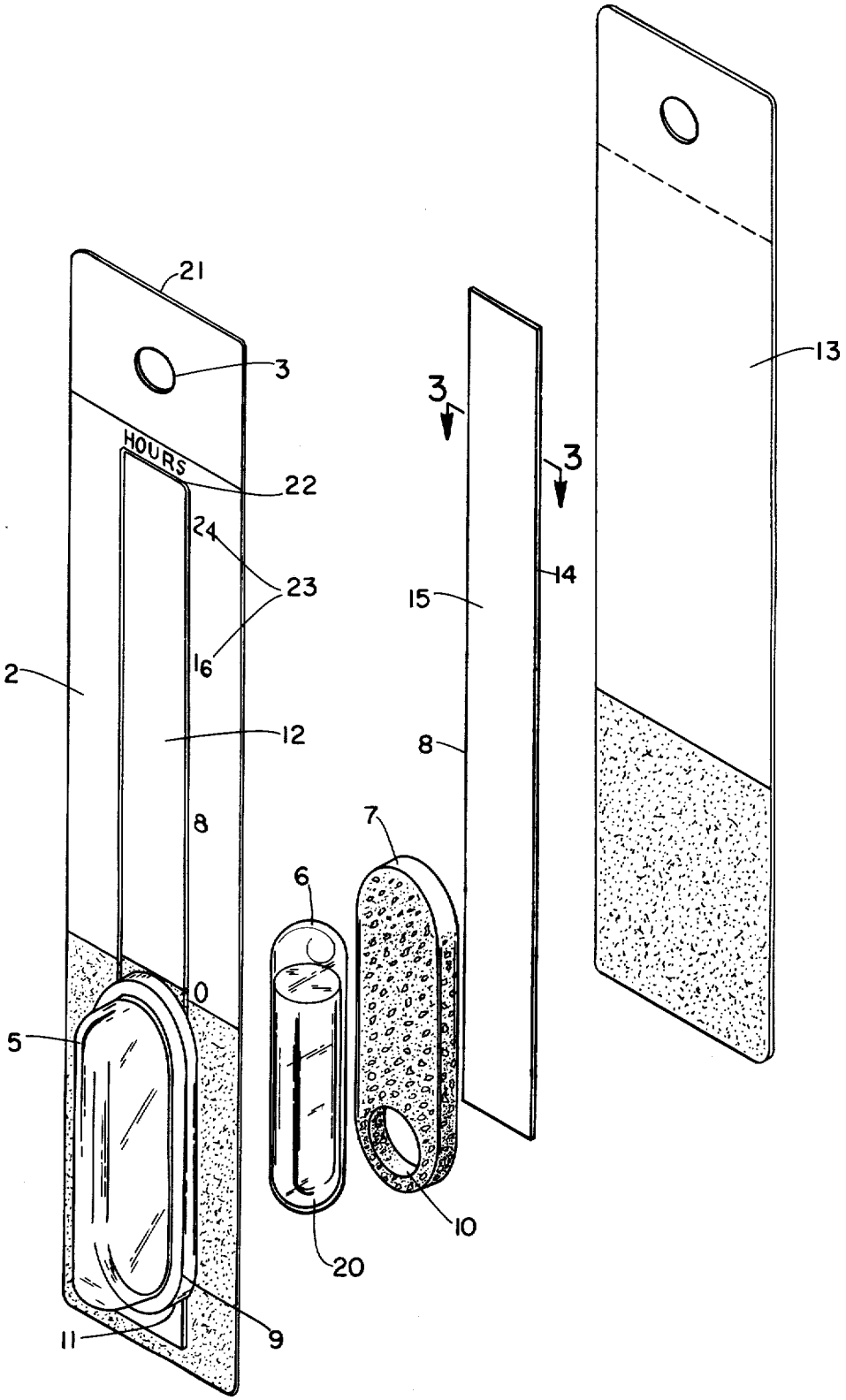
FIG. 2 is an exploded isometric view of the indicator of FIG. 1.

The device includes an easily readable color front indicator portion 4. Indicator portion 4 may also have time indicia inscribed alongside as shown in FIG. 2. The device further includes a raised portion 5 which is an integral part of the blister and which contains the ampule which is better seen with reference to FIG. 2.

As can be seen from FIG. 2, ampul 6 is received in pocket 5 of the blister. Ampul 6 is a frangible ampule and may be made of glass. Ampul 6 carries silicone oil 20 which, in this embodiment, is a polysiloxane and which undergoes only a relatively small change in viscosity with a relatively large change in temperature. The oil per se will be explained in more detail later.

Ampul 6 may be sealed by known heat-seal techniques after it has been at least partially filled with silicone oil. Pocket 5 is made of a relatively thin plastic material such that the pocket may be collapsed and the ampul may be broken by finger squeezing; however, the ampul 6 is protected from being broken if the device is dropped or otherwise roughly handled due to the rigidity of this blister. A porous barrier, which in this embodiment is sponge 7, is positioned between ampul 6 and indicator strip 8. Sponge 7 is received in shoulder 9 which surrounds the periphery of pocket 5. A type of sponge which has been used is Scott Felt 4-900Z sponge, 3/32 inch thick, commercially available from the Scott Foam Division of Scott Paper Company. The sponge is used as a regulator to prevent oil from being splattered all over the strip when the ampul is crushed during activation and to prevent wicking of oil along the front of the strip. At the bottom of the sponge, there is a one-fourth inch diameter hole 10. This hole 10 has a dual function, one of which is to force or control the silicone oil to the bottom of the strip so that an immediate indication of activation is given the observer through the bottom window 11 of the blister 2. Furthermore, by forcing the oil to the bottom of the strip, the device is made much more accurate because the movement of the oil up the capillary strip 8 always began at the very bottom of the strip, so long as the device is hung properly, thus gravity forces the oil through the hole in the sponge to the bottom of the strip. Porous strip 8 is adapted to be received in channel 12 of the blister. Channel 12 is slightly raised for receiving the capillary strip. Whatman paper (a filter paper) is used as a porous strip in one of the embodiments of the invention. In one embodiment of the invention, the strip includes multiple layers of porous carriers which will be explained in reference to FIG. 3.

Referring again to FIG. 2, the back side of the indicator is closed by use of a backing 13 which is heat sealed to the blister 2. The blister and backing, in one embodiment, are 7½ mil thickness polyvinylchloride thermaform plastic.

The front side 15 of the strip is unprinted. In one embodiment, the back side of strip 8 is printed with an ink containing a dye which is at least slightly dispersible in silicone oil. The print layer is indicated by 14. An example of a dye which is at least slightly dispersible in silicone oil is Sudan Red O, available from the GAF Corporation. The Whatman paper strip 8 may be printed using the following formulation: 10 grams of Sudan Red O as a dye is mixed with 20 grams of polyisobutylene. The polyisobutylene acts as a binder or blocking agent to prevent the dye from prematurely penetrating to the other side of the strip. The Sudan Red O and the polyisobutylene are mixed with 100 ml of cyclohexane which acts as a solvent for the mixture. Seven (7) ml of ethyl acetate is added to provide for a deeper, more intense color when the dye comes in contact with the silicone oil. The mixture is exposed to one side of the Whatman paper and then the Whatman paper is exposed to the air, causing the solvent, cyclohexane, to be driven off. The mixture then solidifies and the dye is bound to one side of the Whatman strip.

Figure 3:
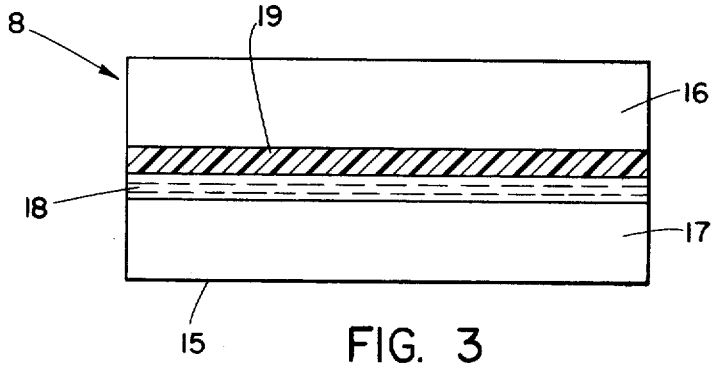
FIG. 3 is a cross-sectional view of the strip sectioned at 3—3, shown in FIG. 2 and incorporating other features of this invention.

As stated previously, a compound capillary strip made of two or more sheets of Whatman paper may be utilized. This may be better understood in reference to FIG. 3. FIG. 3 shows a cross-section of the strip 8 which utilizes two strips 16 and 17 of Whatman paper. Strip 17 is printed along its length as described above with a dye indicated as layer 18. Polyethylene layer 19, approximately 3 mils thick, is melted between the two strips, thus bonding the two strips together. The top (undyed) side of Whatman strip 17, indicated as 15, is placed in and thus exposed to the window 12 of the indicator. The bottom strip 16 keeps the dissolved dye from contacting the bottom of the indicator and going up the sides and bottom of the indicator channel due to capillary action. Without this composite strip, there could be a premature showing of color up the channel. Thus, this particular composite strip has utility in other indicators besides the time indicator.

Referring again to FIG. 2, ampule 6 is filled with a silicone oil 20. The silicone oil should have a viscosity which is relatively unaffected by changes in temperature, and furthermore should be hydrophobic, that is, the viscosity should not be affected by the presence of humidity. One particular type of silicone oil which has been utilized is a Union-Carbide L45 Silicone Fluid with a viscosity of 500 centistokes. L45 Silicone Fluid is available from the Union-Carbide Company with viscosities ranging from 7-100,000 centistokes. The 500 centistoke type was used due to the geometry of the wick and the timing desired, however, other viscosities may be used.

As stated previously, the composite Whatman wick impregnated dye, as shown in FIG. 3, has been utilized. The wick was 2½ inches in total length and 1-9/16 inches of such length was exposed to silicone oil for a 24 hour period. The Union-Carbide L45 Silicone Fluid is dimethylpolysiloxane and is represented by the formula $$CH_3-\underset{CH_3}{\overset{CH_3}{Si}}-O-\left[\underset{CH_3}{\overset{CH_3}{Si}}-O-\right]_x\overset{CH_3}{\underset{CH_3}{Si}}-CH_3$$

where X is a whole number greater than 0. Dimethylpolysiloxane has a $Q_{10}$ of 1.1, $Q_{10}$ being a number indicated by the following formula $$Q_{10} = \frac{\text{Av. completion time (or distance traveled) at } t^\circ\text{C.}}{\text{Av. completion time (or distance traveled) at } t - 10^\circ\text{ C.}}$$

A $Q_{10}$ of 1 means that the device is temperature independent over a calculated temperature range.

It is believed that other polysiloxanes having other carbon-hydrogen side groups would also be temperature and humidity independent. The polysiloxane family is indicated by the following formula $$\left[\underset{Z}{\overset{Z}{Si}}-O\right]_x$$

where x is a whole number greater than 0, wherein Z is $C_AH_B$, B=3A, A is a whole number greater than 0.

As stated previously, the porous strip 8 may be Whatman paper strip. Whatman paper is supplied by the Whatman Company, and is basically a common filter paper having thousands of interconnected micropores. The bottom side of the strip or in the case of the composite strip, the inside of one strip 18, is printed with a dye which is at least slightly soluble in the silicone oil, but should not be soluble in water in order to maintain the device humidity insensitive. As stated previously, Sudan Red O, which is a GAF Corporation dye with a common name Solvent Red 26, was utilized as a dye in one embodiment. The formula for this dye is indicated as CI26120. When the silicone oil comes into contact with the dye, the oil carries the dye from the back to the front, thus a color front slowly moves up the strip 8 due to capillary action of the silicone moving up the strip and pulling the dye out of the back side of the strip.

Other dyes which are at least slightly soluble in silicone oil and insoluble in water which have been found to provide an acceptable time indication are also available from GAF Corporation and are known as Sudan Orange, Sudan Blue, a mixture of 8 grams of Sudan Red O and 2 grams of Sudan Orange, Sudan IV and Sudan I. All of these dyes were printed onto paper strips by the utilization of the same formulation as indicated previously, except, of course, different dyes were used in each case.

The device operates in the following manner: After the device has been attached to intravenous tubing through hole 3 with side 21 being the top side, and the intravenous tubing is operating, the device is activated by hand-squeezing pocket 5 with such pressure that frangible ampul 6 fractures. The fracture of frangible ampul 6 causes the silicone fluid to immediately drain to the bottom of pocket 5 and through hole 10 of sponge 7. Sponge 7 prevents the silicone oil from wicking up between front blister and strip and from splattering onto any other part of indicator 8 upon breakage of ampule 6. As soon as the oil travels through hole 10 onto Whatman paper strip 8, it almost immediately provides a color indication through window 11 of the blister pack 2. Thus, the dye from the back side of the Whatman strip 17 is pulled to the front side for an immediate visual indication that the device has been activated. In the case of the use of Sudan Red O, the indicator strip will be changed from white to a red color. The porous nature of the Whatman strip causes the silicone oil to slowly move up the strip towards the top of the strip 21, thus capillary action is utilized in two dimensions, that is, the silicone moves toward the top of the strip 21 and the silicone oil dissolves some of the dye on the back side of the strip and moves the dye to the front of the strip 15, causing a color front to move up towards the top of the strip as a function of the passage of time.

Indicia 23 may be provided along the side of the raised portion 12 of the blister, which encloses the strip in order to show how much time has passed since activation. In this embodiment, the time indicator is programmed to indicate the passage of 24 hours. This programming is a function of the viscosity of the silicone oil and the length of the strip and to the type of strip. In this embodiment, the strip was 3-3/16 inches long and ¼ inch wide. The sponge was 3/32 inch × ⅜ inch × 1⅜ inch long. One further parameter of the above-mentioned dyes is that they are not soluble in ethylene oxide because quite often, the intravenous tubing is sterilized in ethylene oxide. If the dyes were soluble in this solution, a false indication could occur.

The ampul was filled with 5/10 cc of 500 centistoke Union-Carbide L45 Silicone Fluid. It has been found that this device, as stated previously, has a $Q_{10}$ of approximately 1.1 and is particularly temperature insensitive in the ranges of temperature which may be more than likely encountered in hospital situations such as between 20° C. and 30° C. Supporting data showing such temperature and humidity insensitivity of the device described above and using the composite strip shown in FIG. 3 is as follows:

| AVERAGE COLOR FRONT MOVEMENT | TEMPERATURE | TIME | NUMBER OF SAMPLES | STANDARD DEVIATION | RELATIVE HUMIDITY |
|---|---|---|---|---|---|
| 29 mm. | 25° C. | 24 hr. | 15 | .8 | *NM |
| 29 mm. | 25° C. | 24 hr. | 15 | .6 | *NM |
| 29 mm. | 25° C. | 24 hr. | 15 | .6 | *NM |
| 26 mm. | 20° C. | 24 hr. | 7 | .3 | 50% |
| 28 mm. | 25° C. | 24 hr. | 9 | .9 | *NM |
| 28 mm. | 30° C. | 24 hr. | 7 | .6 | 14% |
| 29 mm. | 30° C. | 24 hr. | 7 | 1.0 | 72% |

*NM means not measured

Thus, Applicant has provided a time indicator which is substantially independent to changes in temperature as well as relative humidity.

From the foregoing description of the embodiment of the invention, it will be apparent that many modifications may be made therein. It will be understood that this embodiment of the invention is intended as an exemplification of the invention only, that the invention is not limited thereto. It is to be understood, therefore, that it is intended in the impended claims to cover all such modifications that follow in the true spirit and scope of the invention.

What is claimed is:

1. A time indicator device comprising: a reservoir, said reservoir containing dimethylpolysiloxane; a porous indicator member, one side of said porous member being impregnated with a dye, said dye being at least slightly dispersible in said dimethylpolysiloxane; said reservoir and said porous member being in a close relationship with one another; said dimethylpolysiloxane adapted to escape from said reservoir upon activation of said reservoir wherein said dimethylpolysiloxane will spread onto said porous member, said dimethylpolysiloxane wetting said porous member thus permitting said dye to flow from said one side of said porous member to the other whereby the movement of said dimethylpolysiloxane on said porous member provides an indication of the passage of time, said dimethypolysiloxane being substantially independent of temperature and relative humidity.

2. A device as set forth in claim 1 wherein said dimethylpolysiloxane has a viscosity between 7–100,000 centistokes.

3. A device as set forth in claim 2 wherein said dimethylpolysiloxane has a viscosity of approximately 500 centistokes.

4. A device as set forth in claim 1 further including an absorbent barrier means situated between said reservoir and said porous indicator member for preventing said dimethylpolysiloxane from prematurely moving onto remote portions of said indicator member upon activation.

5. A device as set forth in claim 4 further including a hole in said absorbent barrier, said hole providing a flow path for said dimethylpolysiloxane onto a predetermined portion of said porous indicator means.

6. A device as set forth in claim 4 further including means to attach said device to intravenous tubing.

7. A device as set forth in claim 1 further including a housing covering said reservoir and said porous indicator member.

8. A device as set forth in claim 7 wherein said housing includes a first optically clear portion contiguous with said porous material providing a visual indication of the elapse of time.

9. A device as set forth in claim 8 further including time indicia associated with said optically clear portion.

10. A device as set forth in claim 9 further including a second optically clear portion adjacent to said reservoir, said hole in said porous barrier being situated near said second optically clear portion, whereby upon the breaking of said reservoir, an immediate indication of activation is indicated.

11. A device as set forth in claim 1 wherein said porous indicator member is a composite piece having a first and second strip of porous material being adhered to each other, the side of one of said strips adjacent the other of said strip having said oil soluble dye printed thereon.

12. A device as set forth in claim 1 wherein said dye is taken from the group consisting of Sudan Red O, Sudan Orange, Sudan Blue, a mixture of Sudan Red O and Sudan Orange, Sudan IV and Sudan I.

13. A device as set forth in claim 12 where said dye is Sudan Red O.

14. A device as set forth in claim 1 further including an amount of ethyl acetate mixed with said dye.

15. A device as set forth in claim 1 further including an amount of polyisobutylene mixed with said dye for preventing said dye from prematurely penetrating to the other side of said porous indicator member.

16. A time indicator comprising: a frangible ampul; a liquid contained in said ampul; an indicator strip located in a close proximity to said ampul; a sponge forming a reservoir of said liquid after said ampul is broken, said sponge substantially separating said ampul from said strip, whereby the deposition of said liquid onto said strip is controlled by said sponge, said sponge further preventing said liquid from splattering onto said strip upon the breaking of said ampul, said sponge including means to control flow of the liquid.

17. An indicator as set forth in claim 16 wherein said flow controlling means said sponge further includes a hole therethrough whereby said liquid is initially deposited on a predetermined place on said strip.

* * * * *